United States Patent [19]

Polley

[11] 4,262,285

[45] Apr. 14, 1981

[54] PERSONAL ALARM

[76] Inventor: Thomas L. Polley, 3853 Camelot Circle Apartment 101, Decatur, Ill. 62526

[21] Appl. No.: 131,263

[22] Filed: Mar. 17, 1980

[51] Int. Cl.[3] ..... G08B 15/00

[52] U.S. Cl. ..... 340/574; 340/393

[58] Field of Search ..... 340/63, 393, 394, 540, 340/571, 574

[56] References Cited

U.S. PATENT DOCUMENTS 3,594,748 7/1971 Grotjahn ..... 340/574

*Primary Examiner*—Alvin H. Waring

*Attorney, Agent, or Firm*—Richard D. Law

[57] ABSTRACT

A personal alarm device which provides for both intermittent actuation of a personal alarm as well as irreversible actuation of such alarm by the provision of multiple actuation modes including a positive displacement device which is lever and spring controlled to move a pin within the device out of restraining engagement with an alarm actuator mechanism in a manner which will prevent deactivation of the alarm by return of the pin to its previous position.

3 Claims, 4 Drawing Figures

PERSONAL ALARM

BACKGROUND OF THE INVENTION

This invention relates to personal security devices and particularly to a portable personal alarm or signaling device. Concern about personal security against street crime has prompted the development of many kinds of portable alarms and signaling devices attempting to discourage mugger, and other criminals from continuing an attack after an alarm is sounded. Typical of such devices are those disclosed in the King U.S. Pat. No. 3,832,705, Yannuzzi U.S. Pat. No. 3,614,763 and others. The concepts described in King for the activation of a personal alarm device are salutory since most street crime does involve the surprise of an intended victim, making it difficult or impossible for the victim to activate any device for protection or alarm.

It is important, however, when present in high crime areas that the alarm not only be easily actuated but, also, loud, insistant and not easily defeated. The prior art devices while each attempting to accomplish some of these objectives in some measure depended for their effectiveness on the ignorance of the attacker in being able to overcome the actuation mechanism, and in this regard they were not "fail safe" against an attackers knowledge of such devices.

It is, therefore, an object of the present invention to provide a new and improved personal alarm device that is capable of being actuated quickly and surely even in the event of a surprise criminal attack.

It is, also, an object of this invention to provide a personal alarm which can not be deactivated by a criminal or accomplice.

BRIEF DESCRIPTION OF THE INVENTION

Figure 1:
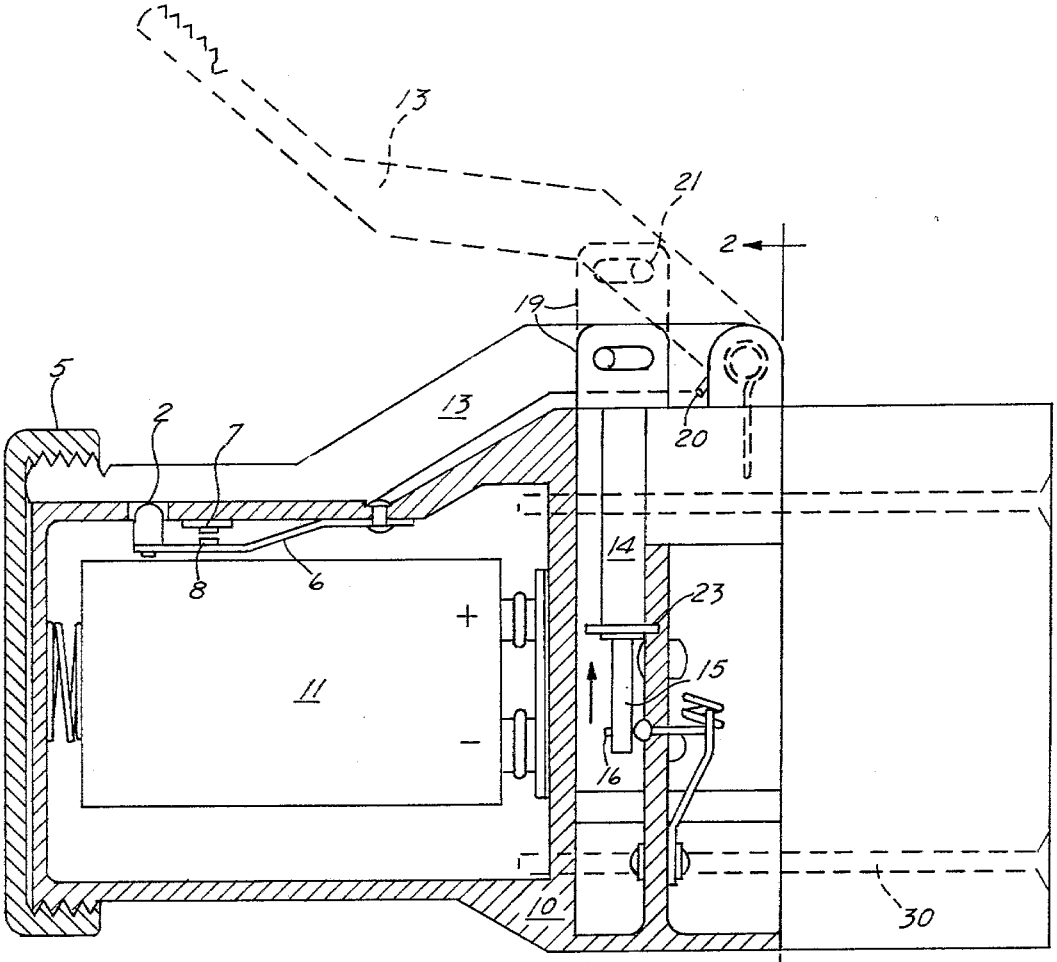
FIG. 1 is a partially sectioned side view of the personal alarm device of the present invention.
Figure 2:
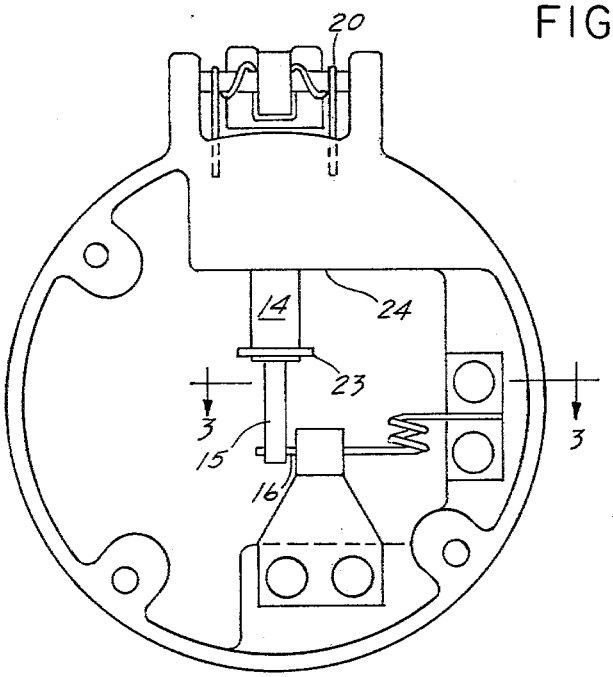
FIG. 2 is cross section of FIG. 1 taken along the lines and arrows numbered 2—2.
Figure 3:
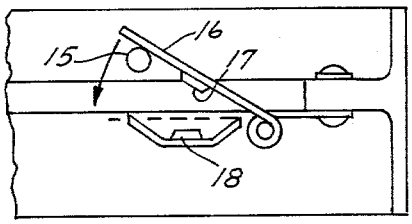
FIG. 3 is a partial section of the switch mechanism of FIG. 2 taken along the lines and arrows numbered 3—3.

A portable personal alarm device is provided which is activated simply and positively by the release of a spring biased lever which pulls a pin lock from between electrical contacts, which contacts are normally spring biased toward the closed or conducting position. The pin after removal can not be returned into the position which could deactivate the electrical connectors. The entire device must be disassembled before the alarm device could be silenced or the battery is fully discharged. In the embodiments described herein, this disassembly may only be accomplished through the use of tools for removing the bolts holding the siren or alarm compartment to the main body of the device.

In practice and use, the device of the present invention may be armed or prepared for activation by removal of a threaded cap from the end of the device opposite the alarm, while the actuation lever is held by hand in the depressed or closed position. With the cap removed, the device may be held in hand indefinitely under the conditions that pose a threat to personal safety; such as the holder's temporary presence in high crime rate areas of a city after dark. After such a threat has passed, the screw-on cap may be returned to its position on the device, thereby locking the actuation lever in its inoperative position. If a threat is encountered while the cap is removed, simply dropping the unit or releasing the activating lever permits it to snap to an open or active position by the action of the biasing spring, thereby lifting a rod attached to the lever and a pin attached to the rod positioned within the housing of the device. The function of the pin is normally to keep spring biased electrical switch contacts out of electrical contact. Movement of the lever, rod and pin during actuation of the device permits the electrical contacts to come together to activate the alarm or siren. Recompressing the handle or actuation lever in the device of the present invention does not operate to break the electrical connection thus, made due to the fact that the movement of the spring contact into electrically conducting relationship with the other contact of the alarm circuit moves it out of registery with the axis of longitudinal movement of the rod and pin. Typically, the structure of the device is designed to withstand abuse and can only be disassembled with tools so a would be attacker or the like would be completely frustrated in any attempt to silence the device.

Several modes of operation are contemplated in the device of the present invention. A simple battery operated alarm is described where the actual alarm can be selected from a variety of known sound producing devices including solid state oscillator cicuits powering a small speaker or other electromechanical devices powered by a battery. Likewise, simple sirens powered by the release of gas from $CO_2$ type cartridges or other compressed or liquified gases such as freon can be used. The only structural variations necessary will be the action of the spring from its restrained position to an actuating position out of registery with the described pin.

It is, also, contemplated that the device of the present invention could be constructed of purely mechanical alarm components powered by a wound spring or the like.

Finally, it is also contemplated that the device of the present invention can be adapted for service as a remote security device by providing a spring clip arrangement which is easily removed to actuate the device by a trip wire type of connection with a door window or other closure where desired.

DETAILED DESCRIPTION OF THE INVENTION

The preferred embodiment of the invention is illustrated in FIG. 1–4. It comprises a housing 10 containing the source of power for the alarm, in this case a battery 11 and the alarm actuating lever 13, with its connected rod 14 and pin 15. The pin 15 in the position illustrated in FIG. 1 restrains spring 16 and associated contact 17 out of electrical connection with electrical contact 18. The housing 10 has attached at one end thereof an alarm 1, and at the other end arming cap 5.

The electrical circuits used in the device of the present invention are conventional and a matter of individual choice, however, it is desirable to provide within the circuit a parallel test circuit actuated by spring 6 moving contacts 8 into electrical contact with contact 7 when button 2 is not restrained by actuating lever 13 when it is in its closed position.

The provision of this feature is desireable both for testing the operativeness of the device prior to use or for use of the alarm without taking advantage of its feature of remaining on until the power source is depleted or the unit is disassembled. In this manner, the actuating lever 13 can be permitted by the operator to rise by the force of spring 20 sufficiently for the contacts 8 and 7 to come together to actuate the alarm and the alarm can then be silenced by returning the lever 13 to its fully closed position or the alarm can be left on until it is determined by the user that an attacker is either discouraged or undetered in the latter of which cases the actuating lever can be fully released to leave the alarm on as will be more fully described hereinafter.

The rod 14 is slidebly received in a hole in housing 10 and is provided on its end exposed to the outside of the housing 10 with a yoke 19 which is slotted to receive a pin 21 which is attached to actuating lever 13. As actuating lever 13 is released from its positions shown in solid lines it will (not restrained by threaded cap 5, or the operator) be urged by spring 20 into the position shown by the dotted lines. The pin 21 in the horizontal slot 22 of yoke 19 will then urge the yoke 19 and attached rod 14 to be vertically displaced in a direction out of the housing 10 into the position shown by the dotted lines. The length of travel being determined by the size of the slot 22 and yoke 19 or the stop 23 on rod 14 which will prevent further vertical movement of the rod by engaging the inside wall of housing 10 and 24. In the preferred embodiment of this invention, the distance of vertical travel provided and the length of pin 15 attached to rod 14 below stop 23 are preselected so that the lower extremity of pin 15 rises above the plane of spring 16 releasing it into a position out of registery with the vertical movement of pin 15 so that recompressing spring 20, by returning actuating lever 13 from the position shown by the dotted lines to the position shown by the solid lines, can not act to break the electrical connection formed, such as when FIG. 3 the spring 16 is permitted to close to the dotted line position allowing the electrical contacts 17 and 18 to come into the electrically conducting positions shown. The circuitry (not shown) for actuation of the alarm 1 by battery 11 then simply provides for testing switch contacts 8 and 7 and main switch contacts 17 and 18 to be provided in parallel thereby allowing the alarm to be intermittently actuated by closing contacts 7 and 8, and irreversably actuted by closing contacts 17 and 18 by the mechanical arrangement described.

Figure 4:
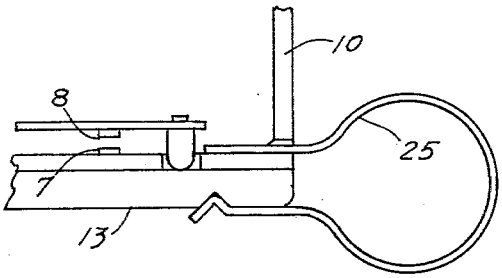
FIG. 4 is a partial view of an alternative embodiment of FIG. 1.

FIG. 4 shows how the spring clip 25 can be fastened to the housing 10 to hold the actuating lever 13 in the closed position. In the position shown the rod keeps contacts 7 and 8 separate.

A trip wire, cord or other means can then be attached to spring clip 25 in a manner to assure that the opening of a door or window or the like will pull spring clip 25 from its position, FIG. 4 completely out of the housing 10. This causes a release of actuating lever 13 to start the alarm by the closing of contacts 7 and 8 by the action of test spring 6. The action of spring 20 should then bring the actuating lever 13 into the fully open position thereby irreversably closing the contacts 17 and 18 and keeping the alarm on. The spring clip 25 is provided with a dimple detent 26 which is received within a recess 27 in actuating arm 13 to prevent accidental actuation of the alarm device, but not provide sufficient hold where a large amount of pulling force is necessary for actuation.

The bolts received through the alarm housing 1 are preferrably threadably received in the housing 10 in a manner which would require hand tools for their removal.

What is claimed is:

1. A portable personal alarm device comprising:

(a) a housing, (b) audible alarm means enclosed in said housing, (c) a plurality of means for activating said alarm means within said housing, wherein the first of said actuating means is a manual actuating means which can intermittently actuate and turn off said alarm means, and the first of said actuation means is disposed completely within said housing and can be deactivated after initial activation by a means for deactivation being exposed to the outside of said housing only after initial activation and (d) a second of said actuating means can irreversably actuate said alarm means and said second activation means comprises a spring biased lever arm connected to said housing, said lever arm slidebly connected to means within said housing for reciprocal movement into said housing and engaging within said housing resilient means for actuating said alarm, which resilient means is capable of irreversably actuating said alarm when said lever and said reciprocally moving means are moved in a direction away from said housing.

2. The personal alarm of claim 1, wherein said lever is restrained from movement into an actuating position by control means which are received on said housing in a position to prevent movement of said lever.

3. The personal alarm of claim 2 wherein said control means is threadedly received on said housing to prevent movement of said lever.

* * * * *